United States Patent [19]

Straitz, III

[11] 3,995,985

[45] Dec. 7, 1976

[54] CRUDE OIL BURNER

[75] Inventor: John F. Straitz, III, Jenkintown, Pa.

[73] Assignee: Combustion Unlimited Incorporated, Elkins Park, Pa.

[22] Filed: Jan. 20, 1975

[21] Appl. No.: 542,594

[52] U.S. Cl. ..... 431/284; 431/285; 431/351

[51] Int. Cl.[2] ..... F23D 11/02

[58] Field of Search ..... 431/202, 278, 284, 285, 431/174, 175, 351, 352, 182, 190

[56] References Cited

UNITED STATES PATENTS

| | | | |
|---|---|---|---|
| 2,665,748 | 1/1954 | Cornelius | 431/352 |
| 3,217,779 | 11/1965 | Reed et al. | 431/285 |
| 3,245,457 | 4/1966 | Smith et al. | 431/352 |
| 3,797,992 | 3/1974 | Straitz | 431/285 |
| 3,807,932 | 4/1974 | Dewald | 431/202 |

*Primary Examiner*—Carroll B. Dority, Jr.
*Attorney, Agent, or Firm*—Z. T. Wobensmith, 2nd; Z. T. Wobensmith, III

[57] ABSTRACT

A crude oil burner is provided particularly suited for oil well testing in Arctic and sub-Arctic regions having a plurality of aligned and spaced air cones to the rear end of which crude oil is delivered, and into which air is induced. Air is also available at the space between the cones and at the front of the front cone. Gas assist heads are provided connected to a ring at the space between the cones and connected to a ring at the front of the front cone for inducing air and aiding in the combustion of the crude oil to provide smokeless combustion. The burner can be mounted for turning in accordance with the wind direction to avoid undesired deflection of the flame by the wind.

7 Claims, 6 Drawing Figures

CRUDE OIL BURNER

BACKGROUND OF THE INVENTION

1. Field of the Invention

This invention relates to crude oil burners and more particularly to a burner useful for oil well testing.

2. Description of the Prior Art

In the testing of oil wells to check the flow capacity and for other purposes it is necessary to dispose of substantial quantities of crude oil preferably by combustion.

Various burners for such disposal have been proposed.

One burner, intended for offshore disposal of crude oil has been proposed, operating with forced draft, but the weight of the airduct for supplying the air is high with attendant supporting problems. The wind-loading of the airduct also introduces serious problems. The burner is of lower capacity than desired and does not eliminate the smoke.

Another type of burner has also been proposed, as shown in Drivet, U.S. Pat. No. 3,565,562 but this is subject to mechanical problems in use.

In my prior U.S. Pat. No. 3,797,992 a crude oil burner is shown which is particularly suited for offshore disposal of crude oil but that burner is intended for very high disposal rates and is not suited for inland use in Arctic and sub-Arctic regions where water is not readily available because of low ambient temperature and remoteness of the location where disposal is required.

In my prior application for patent filed Jan. 14, 1974, Ser. No. 433,255, now U.S. Pat. No. 3,861,857, for Flammable Liquid Waste Burner structure is shown for disposal of flammable liquids having low combustible content and which may not have a sufficient combustible content to burn without fuel addition, water being introduced to avoid smoke emission.

The burner of the present invention utilizes some of the same concepts as are disclosed in my prior patent and application referred to above but is utilized in a different environment which introduces different problems.

SUMMARY OF THE INVENTION

In accordance with the invention a crude oil burner is provided which is particularly suitable for inland use in Arctic and sub-Arctic regions for oil well testing and disposal of unwanted crude oil which includes a plurality of aligned metallic cones, with the crude oil to be burned introduced centrally at the rear end of the rear cone with air entrainment into the rear end of the rear cone, and with combustible gas assist heads between the cones and at the front end of the front cone for effecting complete smokeless combustion.

It is the principal object of the invention to provide a crude oil burner with provisions for introducing combustible gas with air entrainment and turbulence to provide smokeless combustion.

It is a further object of the invention to provide a crude oil burner in which assist gas to eliminate smoke is delivered into the flame in a simple but effective manner.

It is a further object of the invention to provide a crude oil burner in which the parts can be readily replaced if desired.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part thereof, in which.

It should, of course, be understood that the description and drawings, herein are illustrative merely and that various modifications and changes can be made in the structure disclosed without departing from the spirit of the invention.

Like numerals refer to like parts throughout the several views

DESCRIPTION OF A PREFERRED EMBODIMENT

Figure 1:
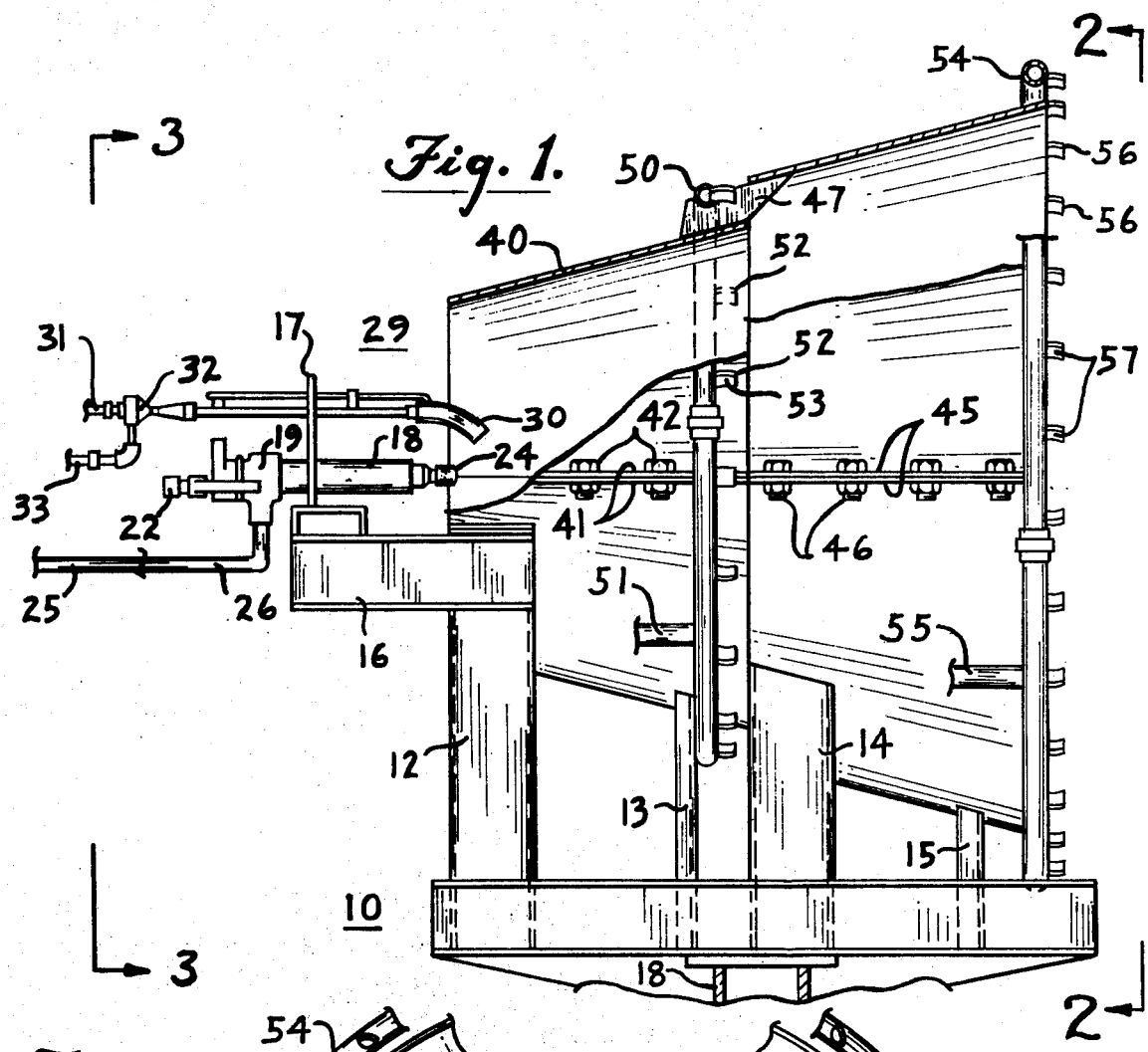
FIG. 1 is a side view partly in section and partly in elevation of a crude oil burner in accordance with the invention.
Figure 2:
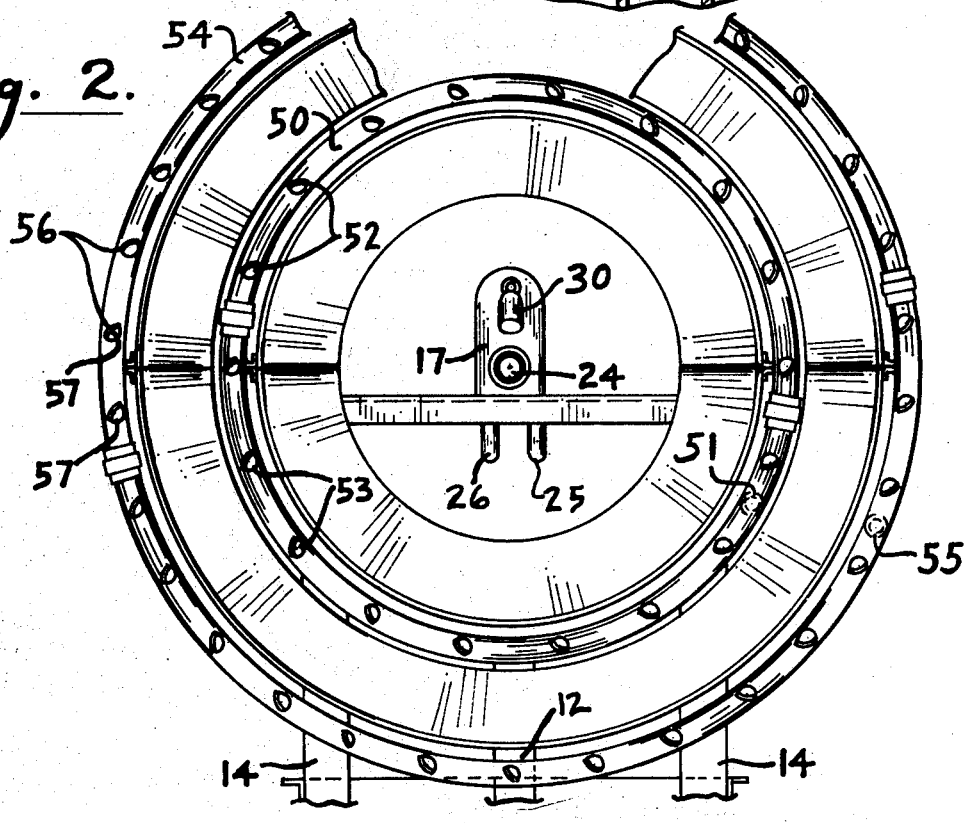
FIG. 2 is a front elevational view taken from the location 2—2 of FIG. 1.
Figure 3:
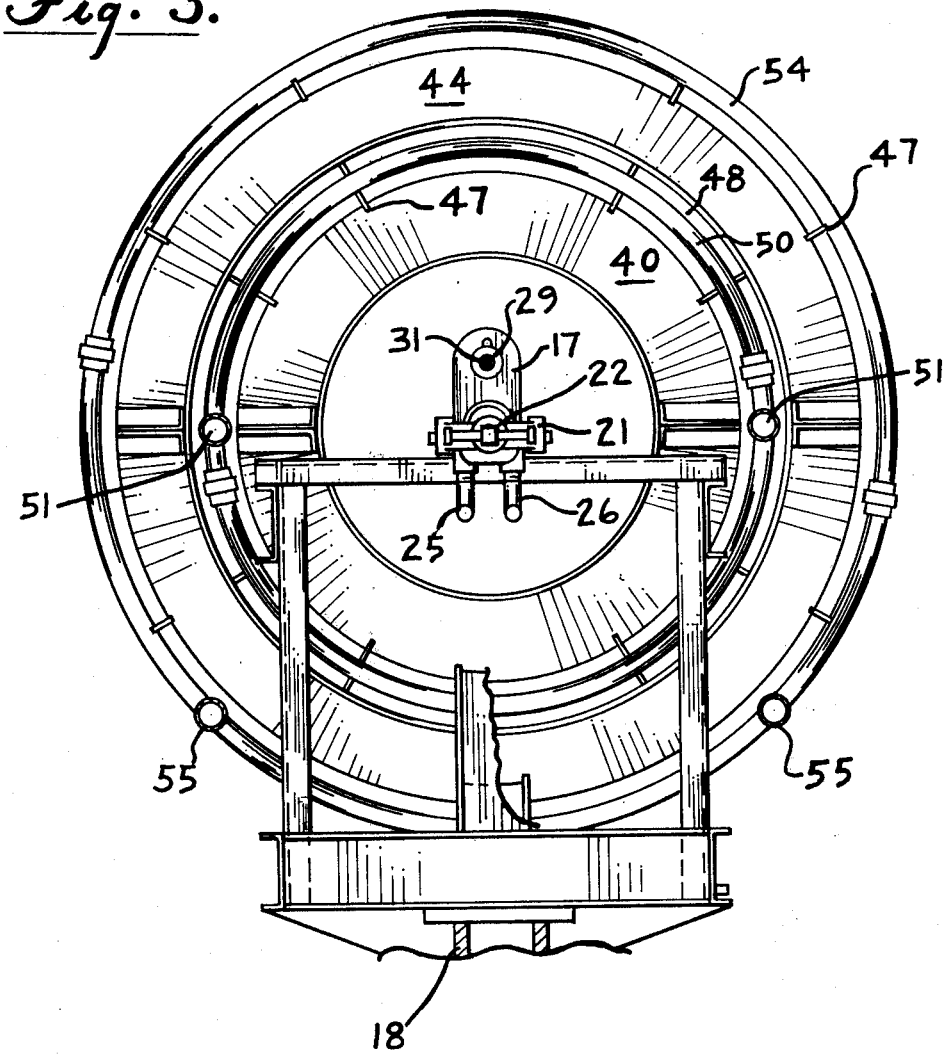
FIG. 3 is a rear elevational view taken from the location 3—3 of FIG. 1.

Referring now more particularly to FIGS. 1, 2 and 3 of the drawings, a supporting frame 10 is shown having a horizontal frame portion 11, with rear uprights 12, intermediate uprights 13 and 14 and front uprights 15. The rear uprights 12 have a horizontal burner gun supporting platform portion 16 from which a burner gun supporting plate 17 extends vertically upwardly.

The frame 10 can have a socket 18 supported on a vertical pivot (not shown) as in my prior application, Ser. No. 433,255, now U.S. Pat. No. 3,861,857, so that the burner can be faced in the desired direction in accordance with the direction of the then prevailing wind, to avoid flame blow back.

The supporting plate 17 carries a centrally located burner gun tube 19 with stationary inlet housing 20 at its rear end. The inlet housing 20 has detachable manifolds 21 held in yokes 22 on the housing 20 by clamping screws 22*a*.

The manifold 21 has a burner tube 23 carried thereby with an oil atomizer burner tip 24 on its front end.

The housing 20 has a pipe 25 connected thereto for delivery through a manifold 21 of crude oil to be burned, and a pipe 26 conneced thereto for the delivery through the same manifold 21 of air under pressure for atomizing the crude oil to be burned.

The use of the detachable manifolds 21 permits of inspecting and servicing the burner as desired.

The supporting plate 17 has a gas pilot 29 carried thereby which includes a shielded pilot nozzle 30. A combustible gas supply pipe 31 is connected to an inspirator 32 which communicates with the nozzle 30 and an adjustable air inlet 33 is provided also connected to the inspirator 32 so that a gas flame can be made available at the pilot nozzle 30.

Provision can be made in a well known manner for igniting the combustible gas-air mixture delivered to the pilot nozzle 30.

A rear cone 40 is provided, of frustoconical forwardly flaring shape and preferably made of a pair of metal sections with longitudinal flanges 41 bolted together by bolts 42. The rear end of the cone 40 is open for entry of air by entrainment and has the front portion of the burner tip 24 centrally disposed therein for discharge forwardly within the cone 40.

A front cone 44 is provided of frustoconical forwardly flaring shape, longitudinally axially aligned with the cone 40 and preferably made of a pair of metal sections with longitudinal flanges 45 bolted together by bolts 46.

The rear and front ends of the cone 40 can be supported by the uprights 12 and 13 and the rear and front ends of the cone 44 can be supported by the uprights 14 and 15. Connectors 47 in the form of plates can be secured in bracing relation between the cones 40 and 44 at spaced locations around the peripheries of the contiguous portions of the cones 40 and 44.

An annular air entry space 48 is provided at the front end of the cone 40 and the rear end of the cone 44 and at that location a rear gas assist supply ring manifold 50 is provided to which a gas assist supply pipe 51 is connected for the supply of assist gas which is preferably high pressure combustible gas from the oil well under test, but in some instances compressed air can be employed in place of the combustible gas.

The supply ring manifold 50 is provided at a plurality of locations spaced therearound with directing heads 52 to each of which high pressure combustible gas or high pressure air is supplied for direction by a cylindrical inner surface 53 forwardly and inwardly into the advancing flame moving into the front cone 44 and entraining air into the cone 44. The positioning of the heads 52 is also for imparting a swirling motion to the advancing flame to aid combustion.

The front cone 44, at the forward end thereof has a front gas assist supply ring manifold 54 disposed therearound and spaced outwardly therefrom for passage of air therebetween. The ring manifold 54 has a gas assist supply pipe 55 connected thereto.

The ring manifold 54 is provided, at a plurality of locations spaced therearound with directing heads 56, like the heads 52, to each of which high pressure combustible gas or high pressure air is supplied for direction by a cylindrical inner surface 57 forwardly and inwardly into the advancing flame to impart a swirling movement to the flame after it has advanced forwardly from the front cone 44 while inducing exterior air into the flame.

Figure 4:
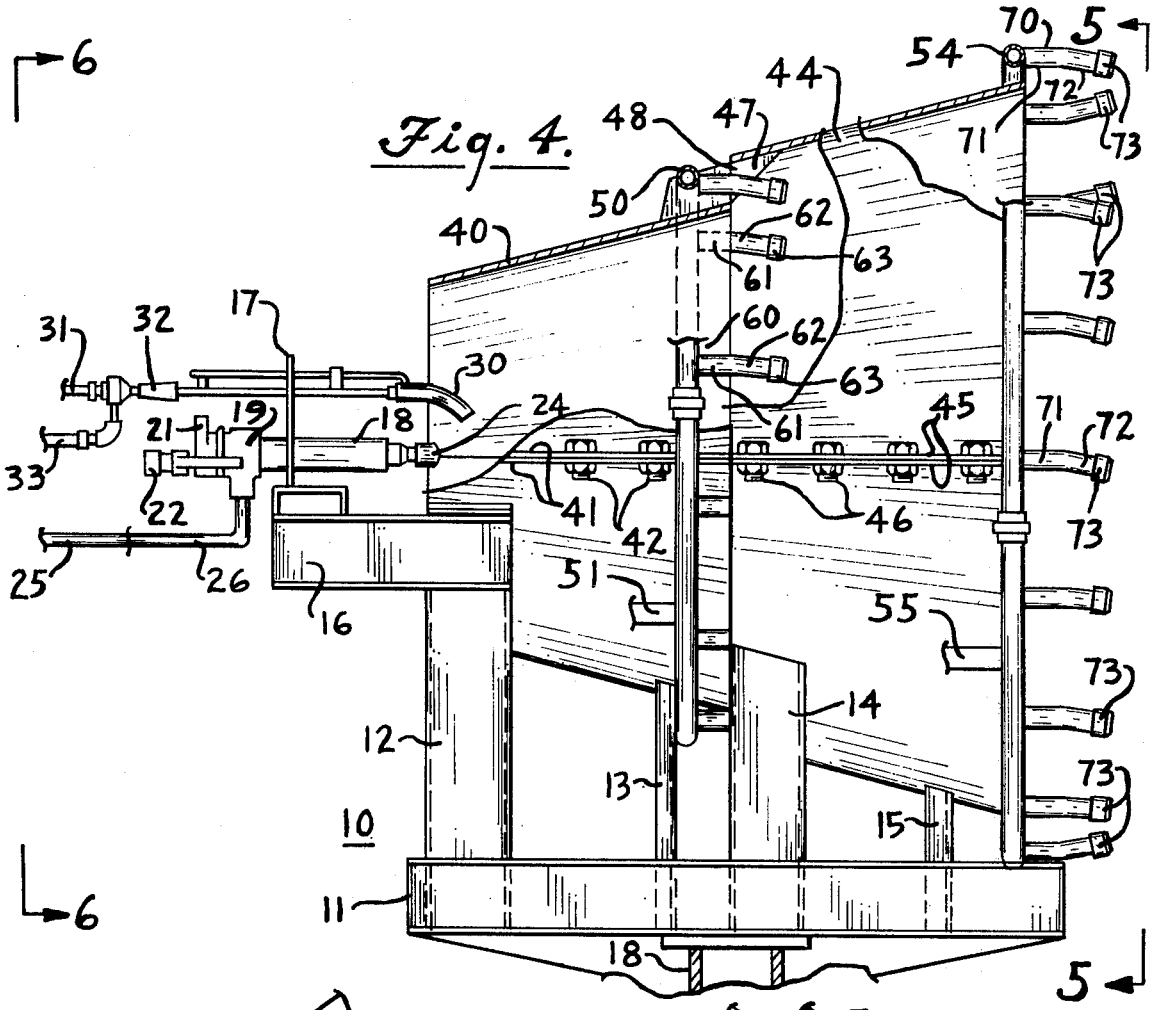
FIG. 4 is a view similar to FIG. 1 showing another embodiment of the invention.
Figure 5:
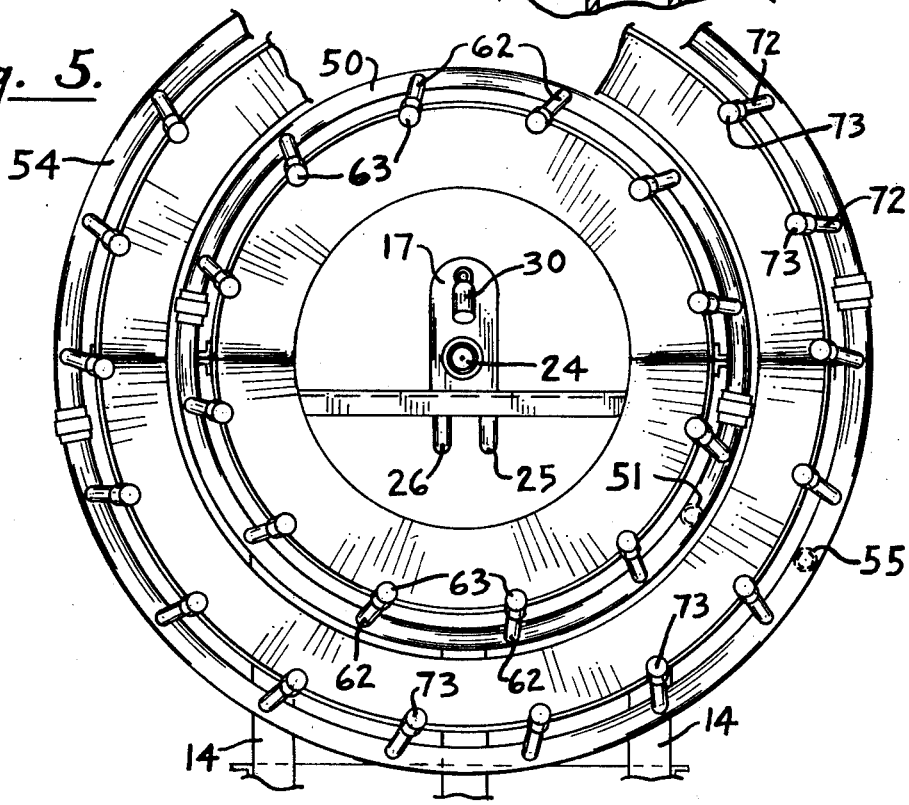
FIG. 5 is a front elevational view taken from the location 5—5 of FIG. 4.
Figure 6:
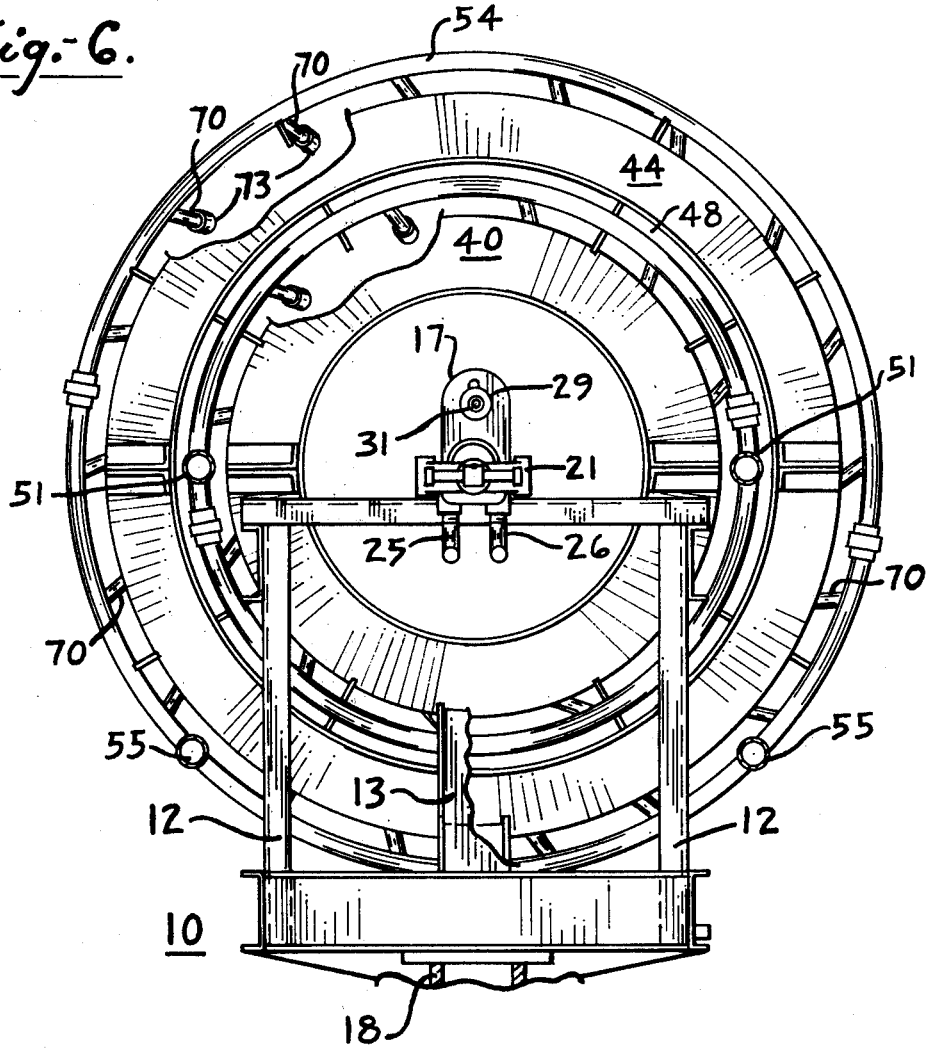
FIG. 6 is a rear elevational view taken from the location 6—6 of FIG. 4.

The structure of the burner shown in FIGS. 4, 5 and 6, is similar to that previously described but differs with respect to delivery heads for the assist gas.

The gas assist supply ring manifold 50 has a plurality of spaced gas delivery pipes 60 connected thereto. Each of the pipes 60 has a portion 61 extending at a right angle from a transverse plane through the manifold 50 and an angularly disposed terminal end 62 with a tip 63. The tip 63, if desired, can be similar to that shown in U.S. Pat. No. 3,463,602, dated Aug. 26, 1969 to Gordon M. Bitterlich.

The pipes 60 with their tips 63 are preferably turned and angularly disposed to direct the high pressure combustible gas or air so as to effect a swirling action of the flame of the burning crude oil moving into the front cone 44 and to inspirate additional air for combustion through the air entry space 48.

The ring manifold 54 is provided at a plurality of locations spaced therearound with spaced gas delivery pipes 70, similar to the pipes 60, with straight portions 71, angularly disposed terminal ends 72 and tips 73, like the tip 63, for directing high pressure combustible gas or high pressure air forwardly and inwardly into the advancing flame to impart a swirling movement to the flame as it advances beyond the front cone 44.

The mode of operation will now be pointed out.

Crude oil to be burned is supplied by the crude oil supply pipe 25 to the burner tip 24 where it is atomized and delivered forwardly at the rear of the rear cone 40 for combustion.

The pilot gas burner 30 causes initial ignition, the burner 30 being ignited if required.

Air for combustion is induced through the rear end of the rear cone 40 and combustion continues through the rear cone 40 and the front cone 44 and a long distance therebeyond and in the direction in which the cones 40 and 44 are pointed.

Combustible gas or air at high pressure from the ring manifold 50 directed by the heads 40, or by the pipes 60 and their tips 63, moves forwardly and inwardly into the flame in the front cone 44 inducing exterior air into the front cone 44 to aid the combustion and imparting a swirling motion to the advancing flame, the turbulence aiding in obtaining smokeless combustion.

Combustible gas or air at high pressure from the ring manifold 54, directed by the heads 56 or by the pipes 70 and their tips 73, moves forwardly and inwardly into the flame advancing from the front cone 44, inducing exterior air into the flame to aid the combustion and imparting a swirling motion to the advancing flame, the turbulence aiding in obtaining smokeless combustion.

The introduction of combustible gas at high pressure, or, in some instances, the introduction of high pressure air in the relation described to the cone 44 has been found effective to obtain smokeless firing of the crude oil and particularly at geographical locations where water or steam are very difficult to employ.

I claim:

1. Apparatus for burning crude oil comprising a support, a crude oil burner carried by said support and delivering crude oil in spray form for combustion, a hollow conical flame directing member open at its front and rear ends, said burner being disposed at said rear end for combustion of said crude oil in said directing member, a gas assist ring manifold contiguous to the front end of said directing member and having delivery members thereon for directing a high pressure non-aqueous combustion assist gaseous medium forwardly and inwardly and inducing air into the flame advancing from said flame directing member, an additional hollow conical flame directing member forwardly of said first mentioned directing member and axially aligned therewith and receiving the flame from said first mentioned directing member, and an additional gas assist ring manifold contiguous to the front end of said second hollow tubular member and having delivery members thereon for directing a high pressure non-aqueous combustion assist gaseous medium forwardly and inwardly into the flame from said additional directing member and inducing air into the flame advancing from said additional flame directing member, the delivery members on at least one of said ring manifolds being disposed to direct the medium in a swirling path.

2. Apparatus as defined in claim 1 in which said first directing member is a rear cone and said additional directing member is a front cone, said front cone at its rear end being spaced from the front end of the rear cone to provide an air entry space and being larger at its front end.

3. Apparatus as defined in claim 2 in which at least one of said manifolds is connected to a source of high pressure combustible gas.

4. Apparatus as defined in claim 2 in which at least one of said manifolds is connected to a source of high pressure air.

5. Apparatus as defined in claim 2 in which said members carried by said manifolds comprise curved directing members.

6. Apparatus as defined in claim 2 in which said members carried by said ring manifolds comprise pipes with tips for directing the gaseous medium to impart a swirling movement to the flame.

7. Apparatus as defined in claim 1 in which at least one of said manifolds is connected to a source of high pressure air.

* * * * *